United States Patent [19]

Buck, Jr. et al.

[11] 4,050,977

[45] Sept. 27, 1977

[54] COMPOSITE BATT AND METHOD FOR PRODUCING SAME

[75] Inventors: George Sumner Buck, Jr.; Robert George Weyker, both of Memphis; Arthur Gerard Ward, Arlington, all of Tenn.

[73] Assignee: Fiberlok, Inc., Memphis, Tenn.

[21] Appl. No.: 612,858

[22] Filed: Sept. 12, 1975

Related U.S. Application Data

[63] Continuation-in-part of Ser. No. 507,485, Sept. 19, 1974, Pat. No. 3,993,518.

[51] Int. Cl.[2] ..... B32B 31/00

[52] U.S. Cl. ..... 156/283; 5/345 R; 156/62.2; 156/62.6; 156/320; 264/122; 428/283; 428/288

[58] Field of Search ..... 156/62.2, 62.6, 283, 156/320; 428/283, 288, 289, 206, 296, 290, 302, 327, 360, 372, 481; 264/122; 5/345 R

[56] References Cited

U.S. PATENT DOCUMENTS

| | | | |
|---|---|---|---|
| 2,568,144 | 9/1951 | Cremer et al. | 428/360 |
| 2,808,098 | 10/1957 | Chavannes et al. | 156/62.6 |
| 2,890,146 | 6/1959 | Unsworth | 428/108 |
| 2,972,554 | 2/1961 | Maskat et al. | 428/360 |
| 3,033,726 | 5/1962 | Howden | 156/62.6 |
| 3,117,055 | 1/1964 | Guandique et al. | 428/290 |
| 3,498,875 | 3/1970 | Lindemann et al. | 428/283 |
| 3,753,826 | 8/1973 | Plummer | 428/206 |

FOREIGN PATENT DOCUMENTS

| | | | |
|---|---|---|---|
| 550,712 | 12/1957 | Canada | 156/62.6 |

*Primary Examiner*—James J. Bell

*Attorney, Agent, or Firm*—Littlepage, Quaintance, Murphy, Richardson & Webner

[57] ABSTRACT

A layered composite batt consists of a plurality of layers, each layer having a series of overlapped, cross-laid webs of fibers. The fibers forming the webs, the webs, and the plurality of layers are bonded to one another to form the composite batt by a melted and resolidified copolymer. The process used in producing the composite batt comprises producing a plurality of open webbed fibers, dispensing particulate copolymer on to each open web of fibers, reciprocatively layering each web and the particulate copolymer carried therewith to form a layer having an upper and a lower face, arranging the layers thus formed such that each layer produced is in face to face contact with at least one other layer thereby forming a plurality of layers, and heating the plurality of layers to a temperature above the melting point of the copolymer but below the scorching point of the fibers. The apparatus used in producing the layered composite batt consists of a conveying means, a plurality of web producing means each for producing a web of fibers admixed with a copolymer, said conveying means and said plurality of web producing means being arranged such that each layer produced is in face to face contact with at least one other layer thereby forming a plurality of layers, and means for heating the plurality of layers to a temperature above the melting point of the copolymer but below the scorching point of the fibers.

3 Claims, 3 Drawing Figures

COMPOSITE BATT AND METHOD FOR PRODUCING SAME

CROSS-REFERENCE TO RELATED APPLICATIONS

This application is a continuation in part of an application entitled Cotton Batt And Method For Producing Such Ser. No. 507,485, filed Sept. 19, 1974 now U.S. Pat. No. 3,993,518.

BACKGROUND OF THE INVENTION

1. Field of the Invention

This invention pertains to an apparatus and process for producing a multi-layered batt by forming a plurality of thin webs of fibers, contacting each web with particles of a copolymer of vinyl chloride and vinylidene chloride, subsequently forming each web into a batt layer, each subsequent batt layer being formed on top of a first formed batt layer, and then heating the resultant composite batt.

2. Description of the Prior Art

Processes for forming layered composite batts using a plurality of garnett machines operating in parallel and perpendicular to a traveling belt are known and described, for example, in U.S. Pat. No. 2,528,091. The bonding agent preferred in that patent was described as an aqueous solution of an "A" stage phenol formaldehyde alone or admixed as by an emulsification with a lubricant such as petroleum oil. This bonding agent was to be applied by means of spray guns directed to the web as the web moves onto a "camel-back" lapper which reciprocatively distributed the web onto the moving belt. This process has a distinct disadvantage of unnecessarily increasing the weight of the composite batt produced and requires unnecessarily large and high power consuming ovens to dry cure the aqueous binder so that individual fibers of the webs are bonded together. The process had the additional disadvantage of repeatedly breaking the web due to the force of the spray which blows holes in the web as the binder material is applied.

U.S. Pat. No. 2,723,707 attempted to prevent the destruction of the thin web by attaching the means for distributing the liquid binder in such a manner as to travel with the "camel-back" mechanism and applying the binder between folds of the webs as it was formed into a batt layer. This process still required the large energy consuming drying mechanism and ovens to cure the dilute aqueous binder.

Completely dry processes for forming fibrous batts are known and are described, for example, in U.S. Pat. No. 3,765,971. However, even this dry process suffers from a number of disadvantages. It has been difficult or impossible to uniformly admix the particulate binding agent with the fibers to be bound thus causing the resultant batt to have non-uniform strength. Additionally, practical dry adhesives which are useable with a wide range of fibers have been particularly hard to identify, thus requiring that any layered batt be manufactured from a single class of fibers.

SUMMARY OF THE INVENTION

It is an object of this invention to produce a multi-layered composite batt having layers of different fiber composition produced in a single operation by running a plurality of garnetts in parallel feeding a single conveyor, the superimposed layers being cured together to produce a multi-component, multi-functional batt. This batt is distinctly superior when used in the construction of mattresses, padded upholstered furniture, and the like.

Most mattresses are made today by laying a three quarter inch insulator pad over the springs followed by an inch or two of cotton batting and finally topped with a five eighths inch layer of polyurethane foam. This individually layered assembly represents an unnecessary waste of energy and labor which could be reduced by producing a multi-layered composite batt according to this invention. Since the layers of the composite batt produced according to this invention would have their interfaces bonded together, the whole of the mattress other than the springs could be produced and assembled in a single operation.

The apparatus for producing a layered composite batt according to this invention comprises a conveying means, a plurality of web producing means each producing a web of fibers dusted with a particulate copolymer, means for reciprocatively laying each of the webs with the particulate copolymer onto the conveying means to form a layer having an upper and lower face, each layer produced being in face-to-face contact with at least one other layer and means for heating the plurality of layers to a temperature above the melting point of the particulate copolymer but below the scorching point of the fibers thereby bonding the layers into a composite batt.

A particular object of this invention is to produce a composite batt for a mattress comprising a cotton layer laminated to a polyester layer wherein the fibers of both of the layers are bonded to one another by melted and resolidified particles of a copolymer of vinyl chloride and vinylidene chloride. The cotton portion of this composite batt serves the same function as the insulator pad in a traditionally manufactured mattress while the polyester layer provides the necessary cigarette resistance as well as the desired touch and resiliency traditionally obtained by having a top layer of polyurethane foam.

DESCRIPTION OF THE PREFERRED EMBODIMENTS

Figure 1:
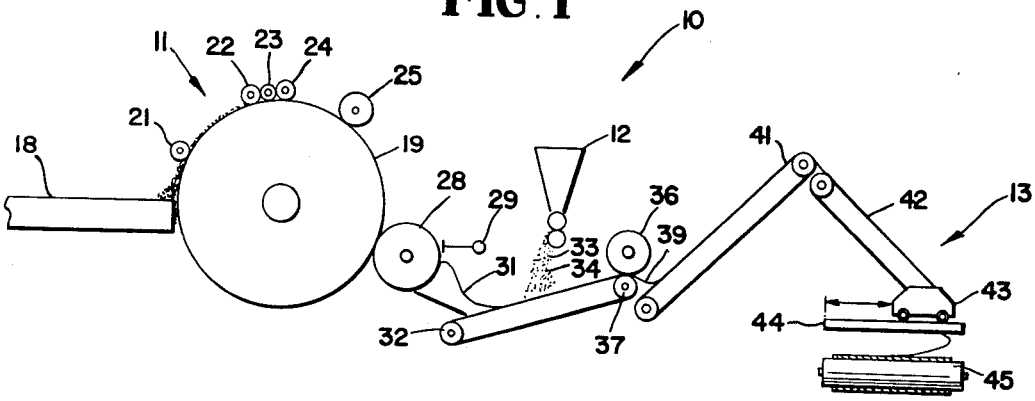
FIG. 1 is an elevation view a web producing means for producing a web of fibers coated with a copolymer suitable for practicing the process of the present invention.
Figure 2:
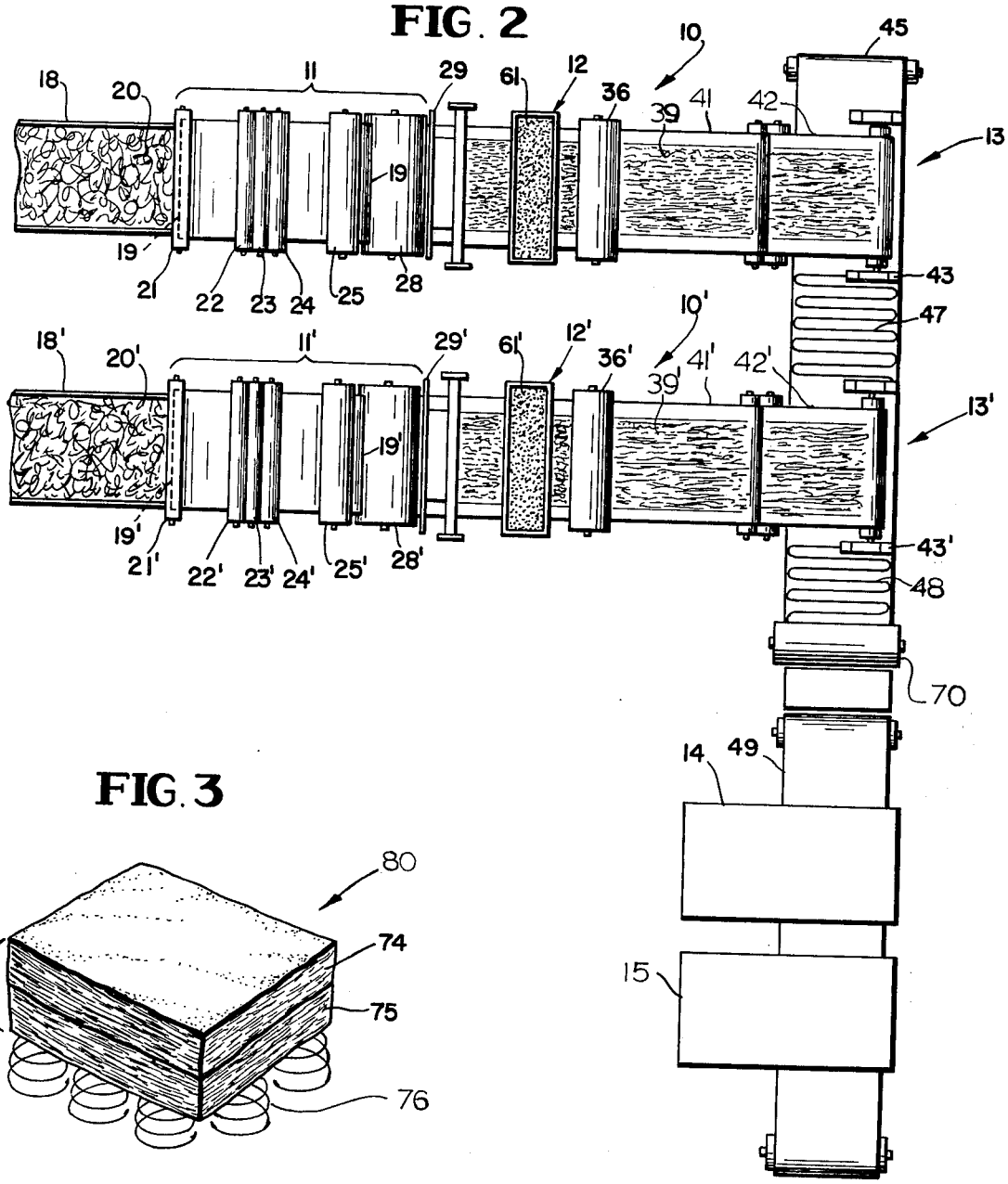
FIG. 2 is a plan view of an apparatus suitable for practicing the process of the present invention including a plurality of web producing means for producing a web of fibers dusted with a particulate copolymer.

Referring now to the drawings, and in particular, to FIGS. 1 and 2, there is shown means 10 for producing a web of fibers admixed with the appropriate copolymer useful for practicing the process of the present invention. The webproducing means 10 comprises means 11 for producing an open web of fibers, means 12 for dispensing particulate copolymers onto the open web, and means 13 for reciprocatively laying the web on conveying means 45. The fiber opening means or garnett 11 comprises an inlet shoot 18 adapted to feed bulk fibers to the rotating drum 19 of the garnett 11. The garnett 11 is also provided with a plurality of toothed rolls 21, 22, 23, 24, 25 which together with the teeth, not shown, on the drum 19 take the bulk fibers 20 and convert them to a web which adheres to the drum 19. The web adhering to the drum 19 is transferred to the drum 28 where it is removed by a comb 29. The web 31, which is now only between 1 and 100 fibers thick and is barely self-supporting, drops to conveyor 32 where it passes under the dispensing means 12.

While on the conveyor 32 and supported thereby, the web 31 is contacted by particles 33, 34 of particulate copolyer 61 which fall from the dispensing means 12 under the influence of gravity. Details of the dispensing means are to be found in Ser. No. 507,485, filed 9/19/74. The particles 33, 34 do not pass through the web 31 but rather are retained by it. To insure retention of the particles 33, 34 by web 31, the web is passed between the nip of two rotating rolls 36, 37. The lower roll 37 performs the additional function of providing a support for the conveyor 32. The combined web with the particulate copolymer 39 then goes to conveyor 41 and then to conveyor 42 of the reciprocating means or "camel-back" lapper 13.

In a manner well known in the art, the lower end of the conveyor 42 is attached to a traveler 43 which moves reciprocatively back and forth on track 44. The conveyor 42 is positioned above and at right angles to conveyor 45. The speed of the conveyor 42 is adjusted to operate several times faster than conveyor 45. By virtue of this arrangement, the web 39 is reciprocatively cross-laid back and forth on the conveyor 45 thus forming a layer 47 having an upper and lower face.

As shown in FIG. 2, a plurality of web-producing means 10 and 10' produce layers 47 and 47' respectively on the single conveyor 45 such that the layers 47 and 47' are in face-to-face contact, thus forming a plurality of layers 48. While only two web-producing means 10 and 10' are shown in FIG. 2, it is to be understood that additional web-producing means could be added for producing a layered composite batt comprising more than two layers. In each web-producing means, the primed and unprimed arabic numerals refer to equivalent elements performing substantially the same function with such minor variations as may be demanded by the particular choice of fibers and copolymers used.

The plurality of layers 48 is passed by conveyor 49 to means 14 for heating the plurality of layers 48 to a temperature above the melting point of the copolymer 61 but below the scorching point of the fibers, thereby bonding the fibers 20 and 20' of the layers 47 and 47' into a composite batt 50. The layered composite batt 50 is then allowed to cool to room temperature. The cooling can be performed by any appropriate means 15 for cooling the composite batt.

In a preferred embodiment two web-producing means 10 and 10' deposit webs 39 and 39' on the same conveyer or floor apron 45 which is moving perpendicularly to the two web-producing means 10 and 10' operating at speeds such that although the webs 39 and 39' are but a thin veil only 1 to 100 fibers thick, the layers 47 and 47' are each approximately 3 inches thick. This is achieved by having the web 39 move at many times the speed of the conveying means 45 while the means 13 known in the art as a "camel-back" mechanism rapidly reciprocates at right angles to the conveying means 45. The six inch thick combination batt 48 passes between the nip of the two rolls 70 which compress the batt to approximately two inches thick after which it is fed into curing oven 14.

The oven 14 contains porous upper and lower screens which constrain the batting at its two inch thickness while it is retained in the oven. Heated air is blown through the batting to soften and melt the particulate copolymer so that the fibers of the batt are bonded together at the individual points of tangency between any particular pair of fibers. Finally the cold air is blown through the batting to resolidify the molten copolymer thus resulting in a batting comprising two layers each approximately one inch thick.

In a preferred embodiment the first garnet 11 processes fibers of 100 percent cotton while the second garnet 11' processes all polyester fibers. A particulate copolymer of vinyl chloride and vinylidene chloride is dusted on each of the webs such that it constitutes approximately 25 percent of the weight of the webs 39 and 39'. After compression of the combination batt comprising a cotton layer and a polyester layer down to the preferred two inch thickness, the combination batt is fed into the oven 14 and is subjected to a temperature of between 300° F and 400° F. for a period from 1 to 20 minutes. At this temperature the copolymer of vinyl chloride and vinylidene chloride softens, melts and collects at the intersections and points of tangency of individual fibers within the layers. The temperature is sufficiently cool that it will not adversely effect the cotton or polyester fibers. The combination batt then emerges from the oven 14 and is allowed to cool to room temperature thus causing the previously melted copolymer to resolidify, bonding the individual fibers of the layers to form a combination batt having the necessary strength and coherence of a batt.

The copolymer preferred for use in the invention generally has a weight ratio of vinyl chloride to vinylidine chloride of 1:99 to 40:60 and preferably 5:95 to 25:75. At higher ratios, the copolymer exhibits no properties not separately obtained by the use of homopolymer of vinyl chloride. Likewise, at lower ratios, i.e. less than 5:95, the copolymer exhibits the properties of the homopolymer vinylidine chloride which is an intractable, high melting material not suitable for this process. The copolymer is applied to a web in amounts sufficient to function as adhesive and generally in a weight ratio of the copolymer to the fiber of 1:99 to 40:60 and preferably 10:90 to 20:80. the copolymer particles generally have a size range from 1 to 200 microns and preferably from 20 to 80 microns. Smaller sizes are useful technologically but are expensive to produce. Larger sizes not only unnecessarily increase the weight of the resulting batt but also reduce the number of cross links possible with a given weight of copolymer which reduces bonding efficiency and strength.

Copolymers useful in the present invention have a sticking point of from 300° to 370° F. All copolymers of vinyl chloride and vinylidine chloride useful in the present invention either have this property or can be modified to produce this property according to techniques well known in the art which form no part of the present invention. Copolymers useful in the present invention are available from the Dow Chemical Company, Midland, Michigan, under the following trade names: Saran Resin XP-5,230.04; Saran Resin XP-2,384.49; Saran Resin XP-4,174.19; Saran Resin XP-5,230.05; Saran Resin XP-5,230.06; and Saran Resin XP-5,230.08.

A combination batt produced according to this invention is not limited to only two dissimilar layers of batting bonded together but could comprise three or more layers, nor is it limited to combinations of only cotton and polyester but may use other fibers which will not experience deteriorating effects at the temperatures necessary to melt the copolymer. An example of a three layered batt is a first layer of cotton with 30 percent of its weight as the copolymer, a second layer of cotton with 20 percent of its weight being copolymer, and a third layer of polyester with 15 percent of its weight being the copolymer. A second example of a three layered composite batt would have the first layer be cotton with 25 percent of its weight being copolymer, the second layer being 80/20 cotton/polyester with 15 percent of its weight being a copolymer, and the third layer being 50/50 cotton/polyester with 15 percent of its weight being the copolymer. The number of different combinations of fibers and blends is virtually unlimited. Each combination, however, provides its own advantage with respect to strength, resilience, cigarette and/or flame resistance, with cost and availability being distinct considerations. For example, while a polyester batt will exhibit cigarette resistance, this material will not be flame resistant unless a very high level of the vinyl chloride and vinylidine chloride copolymer is employed. If enhanced flame resistance is desired, the polyester could be replaced by a modacrylic.

Figure 3:
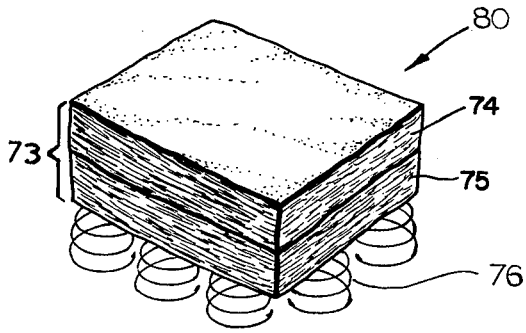
FIG. 3 is a diagramatic view of a mattress assembly using as one element a composite batt produced according to this invention.

A composite batt according to this invention can be used in the construction of a mattress 80 shown generally in FIG. 3. The mattress 80 comprises a composite batt 73 having a plurality of layers 74 and 75 the face of one layer being in contact with a set of springs 76. Preferably the layer adjacent to the springs is 100 percent cotton acting as an insulator against the springs. The layers other than the bottom layer serves as the fill which is conventionally placed over an insulator pad in a mattress. This upper portion preferably contains 100 percent polyester for providing the touch and resiliency conventionally obtained by placing a layer of polyurethane foam over the mattress fill. Not only does this upper layer of polyester batting provide a soft, rich feel to the mattress, but it also provides the desired cigarette resistance to the finished article. In this manner also, since all layers are bonded together at their interfaces, there would be no lateral slippage and the whole mattress could be assembled in a single step rather than the layer upon layer operation conventionally used.

Many other uses for a batt produced according to this invention exist including upholstered furniture, seating in vehicles and aircraft, and gymnasium padding to mention a few. Although the invention has been described in considerable detail with references to certain preferred embodiments thereof, it will be understood that variations and modifications can be effected within the spirit and scope of the invention as described above and as defined in the appendant claims.

What is claimed is:

1. A process for producing a layered composite batt comprising the steps of:

A. Producing a plurality of open webs of fibers,

B. Dispensing a particulate copolymer onto each open web of fibers;

C. Reciprocatively layering each web and the particulate copolymer carried therein to form a layer having an upper and a lower face, D. Arranging the layers thus formed such that each layer produced is in face to face contact with at least one other layer, thereby forming a plurality of layers, E. Heating the plurality of layers to a temperature above the melting point of the copolymer but below the scorching point of the fibers, thereby bonding the layers into a composite, and F. Allowing the composite to cool to room temperature.

wherein Steps A, B, and C are used to produce a layer of cotton fibers having dispensed therein a particulate copolymer of vinyl chloride and vinylidene chloride and Steps A, B, and C are used to produce a layer of polyester fibers having dispensed therein a second particulate copolymer of vinyl chloride and vinylidene chloride and the layers thus produced are arranged according to Step D.

2. The process of claim 1 wherein the particulate copolymers used are the same copolymer.

3. A process for producing a mattress comprising the steps of:

A. Producing a plurality of open webs of fibers, the fibers of at least one of said webs being 100 percent cotton and the fibers of another of said webs being 100 percent polyester, B. Dispensing a particulate copolymer of vinyl chloride and vinylidene chloride into each open web of fibers, C. Reciprocatively layering each web and the particulate copolymer carried therein to form a layer having an upper and a lower face, D. Arranging the layers thus formed in parallel fashion such that each layer produced is in face to face contact with at least one other layer, thereby forming a plurality of layers, E. Heating the plurality of layers to a temperature of between 300° and 400° F, thereby bonding the layers into a composite, F. Cooling the composite to ambient room temperature, and G. Positioning the composite on top of a set of springs.

* * * * *